US007146657B2

(12) United States Patent
Jahnke

(10) Patent No.: US 7,146,657 B2
(45) Date of Patent: Dec. 12, 2006

(54) WATER EQUIPMENT ATTACHMENT APPARATUS

(76) Inventor: Mark G. Jahnke, 462 38th Ave., Kenosha, WI (US) 53144

( * ) Notice: Subject to any disclaimer, the term of this patent is extended or adjusted under 35 U.S.C. 154(b) by 166 days.

(21) Appl. No.: 10/805,826

(22) Filed: Mar. 22, 2004

(65) Prior Publication Data

US 2005/0204465 A1 Sep. 22, 2005

(51) Int. Cl.
*E04H 4/00* (2006.01)

(52) U.S. Cl. ..... 4/507; 4/695

(58) Field of Classification Search ..... 4/492, 4/496, 506, 507, 695; 52/292, 297, 298; 248/519, 530

See application file for complete search history.

(56) References Cited

U.S. PATENT DOCUMENTS

| | | | | |
|---|---|---|---|---|
| 2,952,024 | A * | 9/1960 | Bartolucci | 4/503 |
| 3,225,501 | A * | 12/1965 | McCaron | 52/298 |
| 3,578,023 | A | 5/1971 | Diemond | |
| 4,561,134 | A | 12/1985 | Mathews | |
| 4,589,237 | A * | 5/1986 | Dahowski | 52/169.7 |
| 4,819,681 | A | 4/1989 | Hodak | |
| 4,951,326 | A | 8/1990 | Barnes | |
| 4,980,934 | A | 1/1991 | Dahowski | |
| 5,040,250 | A | 8/1991 | Barnes | |
| 5,040,251 | A * | 8/1991 | Hanford | 4/496 |
| 5,195,191 | A | 3/1993 | Stefan | |
| 5,225,075 | A | 7/1993 | Cunningham | |
| 5,239,709 | A | 8/1993 | Masotti | |
| 5,239,710 | A | 8/1993 | Swinburn | |
| 5,268,096 | A | 12/1993 | Robol | |
| 5,282,282 | A | 2/1994 | Shehan | |
| 5,325,644 | A * | 7/1994 | Cornelius | 52/169.7 |
| 5,408,706 | A | 4/1995 | Barnes | |
| 5,465,436 | A | 11/1995 | Bleicher | |
| 5,647,155 | A | 7/1997 | Hillstrom | |
| 5,695,586 | A | 12/1997 | Stegmeier | |
| 5,759,414 | A | 6/1998 | Wilkes | |
| 5,864,897 | A | 2/1999 | Ross | |
| 5,915,848 | A | 6/1999 | Deason | |
| 5,920,921 | A | 7/1999 | Poole | |
| 5,933,883 | A | 8/1999 | Biancamano | |
| 6,158,062 | A | 12/2000 | Vespo | |
| 6,170,095 | B1 | 1/2001 | Zars | |
| 6,209,586 | B1 | 4/2001 | Wright | |
| 6,250,776 | B1 | 6/2001 | Burkitt | |
| 6,269,493 | B1 | 8/2001 | Sorensen | |
| 6,314,687 | B1 | 11/2001 | Schondelmayer | |

(Continued)

FOREIGN PATENT DOCUMENTS

DE 20 54 596 A1 5/1972

(Continued)

OTHER PUBLICATIONS

International Search Report for PCT/US2004/041,717.

*Primary Examiner*—Huyen Le
(74) *Attorney, Agent, or Firm*—Lesavich High-Tech Law Group, P.C.; Stephen Lesavich

(57) ABSTRACT

A water equipment attachment apparatus. The water attachment equipment apparatus provides a means to attach water equipment such as ladders, handrails, sports equipment, chairs and other equipment into a containing structure of a contained body of water such as swimming pool, fountain, decretive pond, etc. including a flexible material liner such as a vinyl liner. The water attachment equipment apparatus can be attached to a top, side or bottom of the containing structure of contained body of water through the vinyl liner without leaking and provides structural support for any attached water equipment.

23 Claims, 6 Drawing Sheets

U.S. PATENT DOCUMENTS

| | | | |
|---|---|---|---|
| 6,340,035 | B1 | 1/2002 | Wright |
| 6,357,058 | B1 | 3/2002 | Biancamano |
| 6,397,408 | B1 | 6/2002 | Veloskey |
| 6,481,027 | B1 | 11/2002 | Biancamano |
| 6,487,733 | B1 | 12/2002 | Bonelli |
| 6,557,588 | B1 | 5/2003 | Wright |
| 6,568,126 | B1 | 5/2003 | Womack |
| 6,578,208 | B1 | 6/2003 | Lytle |
| 6,595,721 | B1 | 7/2003 | Kincheloe |
| 6,658,674 | B1 | 12/2003 | Bonelli |
| 6,671,895 | B1 | 1/2004 | Lewis |
| 6,708,462 | B1 | 3/2004 | Pokorzynski |
| 6,810,537 | B1 | 11/2004 | Barnes |
| 6,817,042 | B1 | 11/2004 | Stanneck |
| 6,833,067 | B1 | 12/2004 | Dresmann |

FOREIGN PATENT DOCUMENTS

| | | |
|---|---|---|
| EP | 0 854 256 A | 7/1998 |

* cited by examiner

WATER EQUIPMENT ATTACHMENT APPARATUS

FIELD OF THE INVENTION

This invention relates to equipment used in contained bodies of water such as swimming pools, ponds, fountains, etc. More specifically, it relates to a water equipment attachment apparatus.

BACKGROUND OF THE INVENTION

In the recent past, swimming pools, decretive ponds and other contained bodies of water were constructed using concrete or other similar rigid materials. However, there were many problems with constructing such contained bodies of water with concrete and other rigid materials. The concrete was subject to cracking, buckling and chipping leading to leaks on the contained body of water. In colder climates, the cracking problem was even more severe as the contained body of water may be drained and experienced numerous freeze/thaw cycles during a winter season leading to additional cracking. Pools and other contained bodies of water made of concrete or other rigid materials need to be constantly maintained leading to high and perpetual maintenance costs.

In recent years, swimming pools, decretive ponds and other contained bodies of water are being constructed out of more pliable and durable materials such as vinyl and other similar materials. Such pools, decretive ponds, etc. include flexible vinyl liners and that are supported by rigid support walls. The flexible vinyl liners allow pools, ponds, etc. to be created that have innovative sizes and shapes and such contained bodies of water are no longer limited to rectangular and circular shapes.

The support walls comprise plastic, fiberglass, aluminum, pressure-treated wood, dirt and other materials. The walls typically have a top and bottom portion of eight to twelve inches in width connected by a thin panel but are hollow in between the top and bottom portions. The walls are supported by the bracing system that differs from installer to installer. To install a vinyl pool, decretive pond, etc. a hole is dug to reflect a desired size and shape and walls with a desired type of bracing are built around the hole. A liner is placed in the hole and connected to the walls typically by a vinyl rib at the outside of the liner. Holes are cut in the liner for drains, the filtration system and other necessary equipment. Fill material such as dirt and gravel is placed around the walls to give the walls support. The pool is then filled with water and checked for leaks.

However, there are also several problems associated with using vinyl or other flexible materials for pools, decretive ponds, etc. One problem is that it is difficult to include attachment points for ladders, chairs, sport equipment and other water based apparatus in the in the vinyl or other flexible material. Trying to include such attachment points often leads to leaks in the vinyl or other flexible material.

Another problem is that of stability and support for objects attached to attachment points. Vinyl is used for pools, ponds, etc. because of its flexibility. Providing an attachment point in a vinyl pool or pond typically requires an underlying support structure be able to handle significant forces applied to water equipment attached to the attachment points. For example, a 250 pound man holding onto and climbing up a pool ladder, or a water polo net pole withstanding hits to an attached net, etc. However, as was discussed above, the support walls are typically thin and hollow and do not provide any easy way of adequately adding attachment points. In addition, attachment points without rigid support structures also frequently leak and/or cause other damage such as tearing or ripping when a force is applied to equipment attached to the attachment points.

There have been attempts to solve some of the problems associated with attachment points for vinyl pools and ponds. For example, U.S. Pat. No. 4,561,134, entitled "Fitting assembly for vinyl lined pools," that issued to Mathews et al. teaches a fitting and faceplate cap assembly, for use in swimming pools, and the like, with vinyl liners, comprises a fitting member which extends through an opening in the wall of the pool with a flange overlying the opening on the inner surface of the pool. The fitting is hollow to adapt it for connection to water return lines or drain lines commonly used in such swimming pools. The flange on the fitting has a circular groove formed in it with a pair of enlarged recesses extending from the groove on opposite sides of the opening through the fitting. The faceplate cap includes a circular ridge with a pair of spaced projections for matingly engaging the groove and recesses in the faceplate of the fitting. A gasket is attached to the inner surface of the faceplate cap. This gasket has a tacky adhesive on the exposed surface which faces the flange so that when the cap is pressed into place over a vinyl liner (installed in a conventional manner) to engage the groove in the flange, the tacky adhesive on the gasket engages and holds the vinyl liner in place. The cap and fitting are subsequently pressed tightly together by means of a threaded insert in the common opening of the fitting and cap.

U.S. Pat. No. 4,980,934, entitled "Retrofittable receptor device" that issued to Dahowski, et al. describe a longitudinal receptor construction for insertion into a channel or opening and for holding a desired element is provided. The receptor has an inverted L-shape cross section in which a horizontal leg is advantageously suited for retrofit usage in an existing groove or channel opening and has locking features which afford substantially improved capability for holding the receptor and the element inserted into the receptor. The groove into which the receptor is positioned may be the groove contiguous to a swimming pool coping and may be the same groove devised for and used to hold another element such as the peripheral bead of a swimming pool liner. Sufficient gripping force by the horizontal receptor leg in the locking groove or channel is provided by the receptor leg configuration which prevents dislodging of the receptor leg by forces pulling on the receptor or other member which may be present in the opening. Advantageously the receptor may be used on an existing pool coping which has a channel or groove into which the peripheral bead of a vinyl liner which covers the swimming pool bottom is positioned. The securing leg of the receptor of the invention is of slender construction and contoured that it can be accommodated, together with the bead of the swimming pool liner, within a conventional pre-existing channel or groove such as that in the upper inner wall or coping of a swimming pool which houses the bead of a pool liner.

U.S. Pat. No. 5,408,706 entitled "Fitting assembly for vinyl lined pools" that issued to Barnes describes fitting assembly for use in swimming pools, spas, and the like with vinyl liners, comprises a fitting member which is mounted in an opening in the wall of the pool, either flush with the pool wall or with a flange extending over the interior of the pool wall near the opening. The fitting member has a recess in it about its periphery. The vinyl liner then is placed over the fitting member; and a clamp member, which has a predetermined thickness not greater than the depth of the recess, is secured in the recess of the fitting member over the vinyl liner to clamp the vinyl liner between the clamp and the recess of the fitting member. This provides a flush mount or nearly flush mount of the fitting member with the vinyl liner of the pool.

However, these inventions still do not solve all of the problems associated with attachment points for vinyl pools or ponds. It is desirable to provide an attachment point to a vinyl pool or pond that is strong enough to withstand substantial forces.

SUMMARY OF THE INVENTION

In accordance with preferred embodiments of the present invention, some of the problems associated with attachment points in vinyl pools and ponds are overcome. A water equipment attachment apparatus is presented.

The foregoing and other features and advantages of preferred embodiments of the present invention will be more readily apparent from the following detailed description. The detailed description proceeds with references to the accompanying drawings.

BRIEF DESCRIPTION OF THE DRAWINGS

Preferred embodiments of the present invention are described with reference to the following drawings, wherein.

DETAILED DESCRIPTION OF PREFERRED EMBODIMENTS

Exemplary Water Containment System

Figure 1:
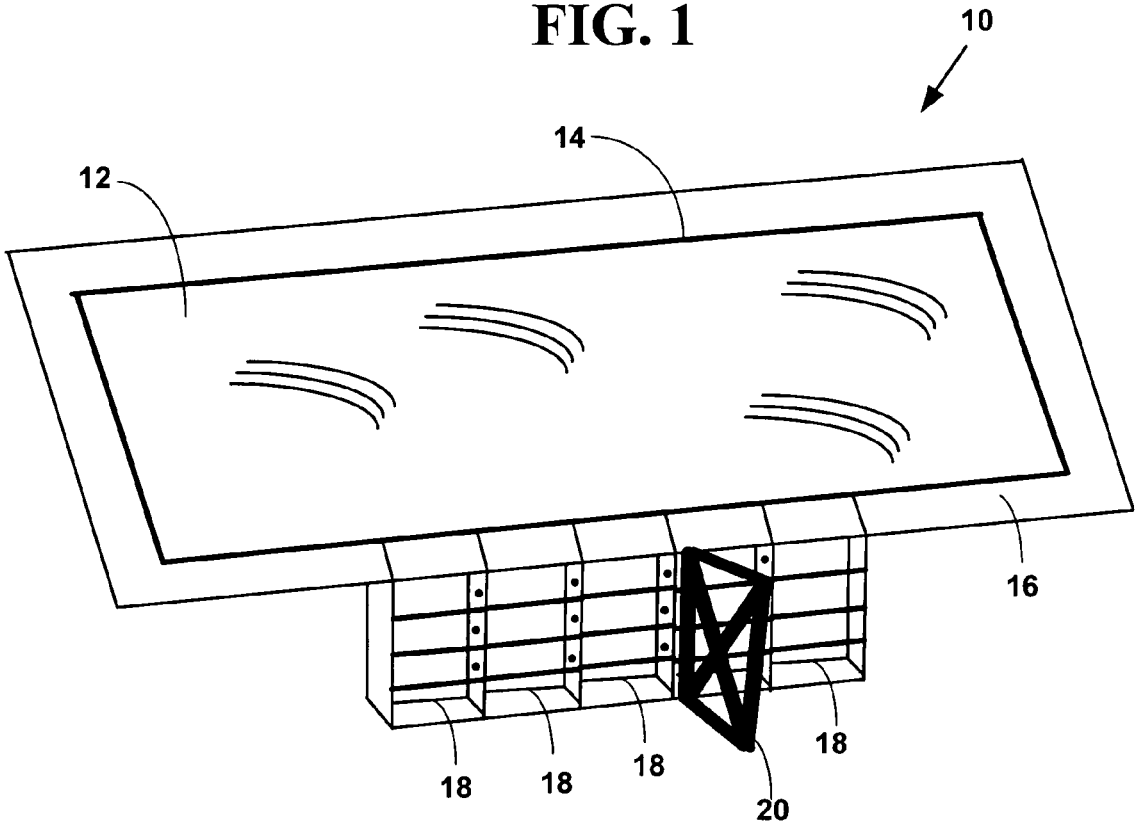
FIG. 1 is a block diagram illustrating an exemplary water containment system.

FIG. 1 is a block diagram illustrating an exemplary water containment system 10. The water containment system 10 includes a contained body of water 12. The contained body of water 12 includes a swimming pool, decretive pond, fountain, spa, whirlpool or other contained body of water used for recreation, personal or aesthetic purposes. The contained body of water 12 is contained by a liner 14 made of a flexible waterproof material such as vinyl or other similar flexible waterproof material that is supported by thin rigid walls 16. Vinyl liners 14 typically range in thickness from about fifteen gauge (mil) to about thirty gauge.

The thin rigid walls 16 typically comprise plural attachable panels 18 (five of which are illustrated). The attachable panels 18 typically have a top and bottom portion that varies in width from about six inches to about twelve inches forming a top and bottom portion of the thin rigid wall with a wall panel in between the top and bottom portion. The attachable panels 18 includes a horizontal component that varies in thickness from about one to about three inches thick and are typically hollow in portion between the horizontal component and an opposite end of a top and bottom portion. The attachable panels 18 typically comprise plastic, fiberglass, composite materials, aluminum, pressure-treated wood, and other types of materials. The walls are supported by a bracing system 20 (one of which is illustrated) that differs from installer to installer. Individual braces 20 are placed at pre-determined intervals around attachable panels 18 to provide support for the rigid walls. FIG. 1 illustrates a cut-away view of plural attachable panels 18 and one brace 20 used for a support bracing system that form the thin rigid walls 16. The attachable panels 18 and the bracing system 20 are buried in some material such as dirt, sand, gravel, etc. to provide support for the thin rigid walls 16.

Figure 2:
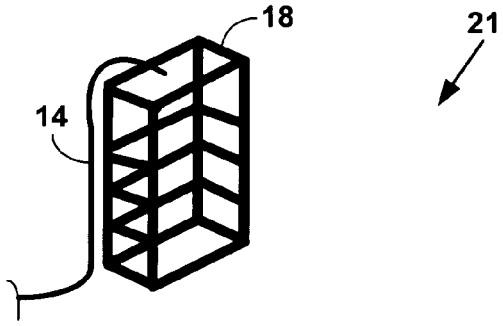
FIG. 2 is a block diagram illustrating a liner and an attachable panel from a rigid wall.

FIG. 2 is a block diagram 21 illustrating a liner 14 and an attachable panel 18 from a thin rigid wall 16. The liner 14 is typically draped over a top portion of the attachable panel 18 and with an attachment means such as plastic coping or some other attachment means.

As FIG. 2 illustrates, it is difficult to provide attachment apparatus to allow attachment of water equipment hand rails, ladders, exercise equipment, chairs tables benches, etc. in a swimming pool, decretive pond, spa, whirlpool that includes a liner 14 supported by thin rigid walls 16. Any attachment points must be able to penetrate the liner 14 without leaking and also allow attachment of water equipment to the thin rigid walls 16 to which large forces may be applied. The attachment points must provide support and operate without causing structural failures or leaks.

Water Equipment Attachment Apparatus

Figure 3:
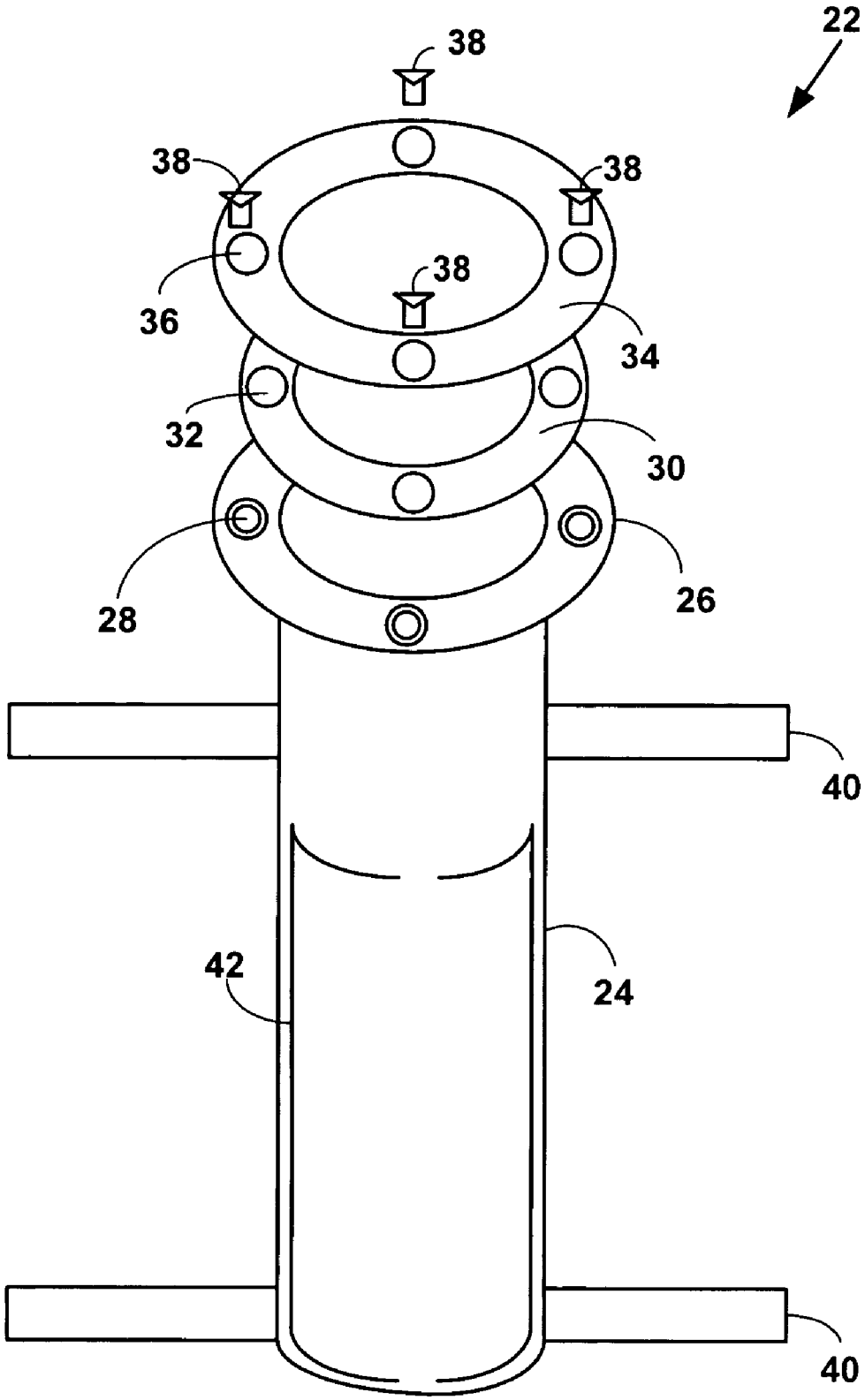
FIG. 3 is a block diagram illustrating a water equipment attachment apparatus.

FIG. 3 is a block diagram illustrating a water equipment attachment apparatus 22. The water equipment apparatus 22 includes a rigid hollow vertical tube 24 for extending below or into a selected surface of a containing structure of a contained body of water including a liner made of a flexible material. The rigid hollow vertical tube 24 includes an attachment member 26 extending beyond a top of the rigid hollow vertical tube for engaging the selected surface of the containing structure of the contained body of water underneath the liner and wherein the attachment member includes plural attachment receptacles 28 therein. The rigid hollow vertical tube 24 comprises metal, plastic or a composite material. However, the present invention is not limited to these embodiments and the rigid hollow vertical tube 24 can comprise other materials.

The water equipment apparatus 22 further includes a gasket 30 having an opening therein for engaging the attachment member of the rigid hollow vertical tube. The gasket is placed over the liner to engage the attachment member 26 of the rigid hollow vertical tube 24. The gasket 30 includes plural attachments openings 32 therein. The gasket 30 comprises a rubber, cork or composite material. However, the present invention is not limited to these embodiments and the gasket 30 can comprise other materials.

The water equipment apparatus 22 further includes a cap 34 having an opening therein for engaging the gasket 30 and for attaching to the attachment member 26 of the rigid hollow vertical tube 24. The cap 34 is placed over the gasket 30 to engage the attachment member 26 of the rigid hollow vertical tube 24, thereby providing a water-tight connection. The cap 30 includes plural of attachment openings 36 therein. The cap 34 comprises a flat or a contoured cap.

However, the present invention is not limited to these embodiments and the cap 34 can comprise other types of caps.

The water equipment apparatus 22 further includes a plural attachment means 38 for attaching the cap 34 and gasket 30 to the attachment member 26 of the rigid hollow vertical tube 24 through plurality attachment openings 32, 36 in the cap and the gasket and into plural attachment receptacles 28 in the attachment member 26 of the rigid hollow vertical tube 24. The attachment means includes screws, bolts, rivets or pins or other types of attachment means. However, the present invention is not limited to these embodiments and the plural attachment means 38 can comprise other types of caps.

The water equipment apparatus 22 further includes one or more horizontal attachment means 40 extending from a first side and a second side of the rigid hollow vertical tube 24 for attaching the rigid hollow vertical tube 24 to the selected surface of the containing structure of the contained body of water.

In one embodiment of the present invention, the one or more horizontal attachment means 40 include a horizontal attachment means 40 that does not extend through the rigid hollow vertical tube 24. In such an embodiment, a horizontal attachment means 40 includes a first piece attached to a first side of the rigid hollow vertical tube 24 and a second piece attached to a second side of the rigid hollow vertical tube 24. This embodiment includes a piece of water equipment 42 inside the rigid hollow vertical tube 24 that does not rest on the one or more horizontal attachment means 40.

This embodiment is typically used on top of a wall 16 or on a side of a wall 16 of a containing structure of the contained body of water 12. This embodiment may be above or below the waterline of a contained body of water. This embodiment is illustrated in FIG. 3 in which two horizontal attachments 40 means are illustrated, which is one preferred embodiment. However, the present invention is not limited to this embodiment and more fewer horizontal attachment means 40 can be used on the rigid hollow vertical tube 24.

In another embodiment of the present invention, the one or more horizontal attachment means 40 includes a horizontal attachment means that extends through the rigid hollow vertical tube 24. In such an embodiment, the horizontal attachment means 40 includes a solid piece of metal, plastic or composite material that is slid through pre-drilled holes in the rigid hollow vertical tube 24.

Figure 4:
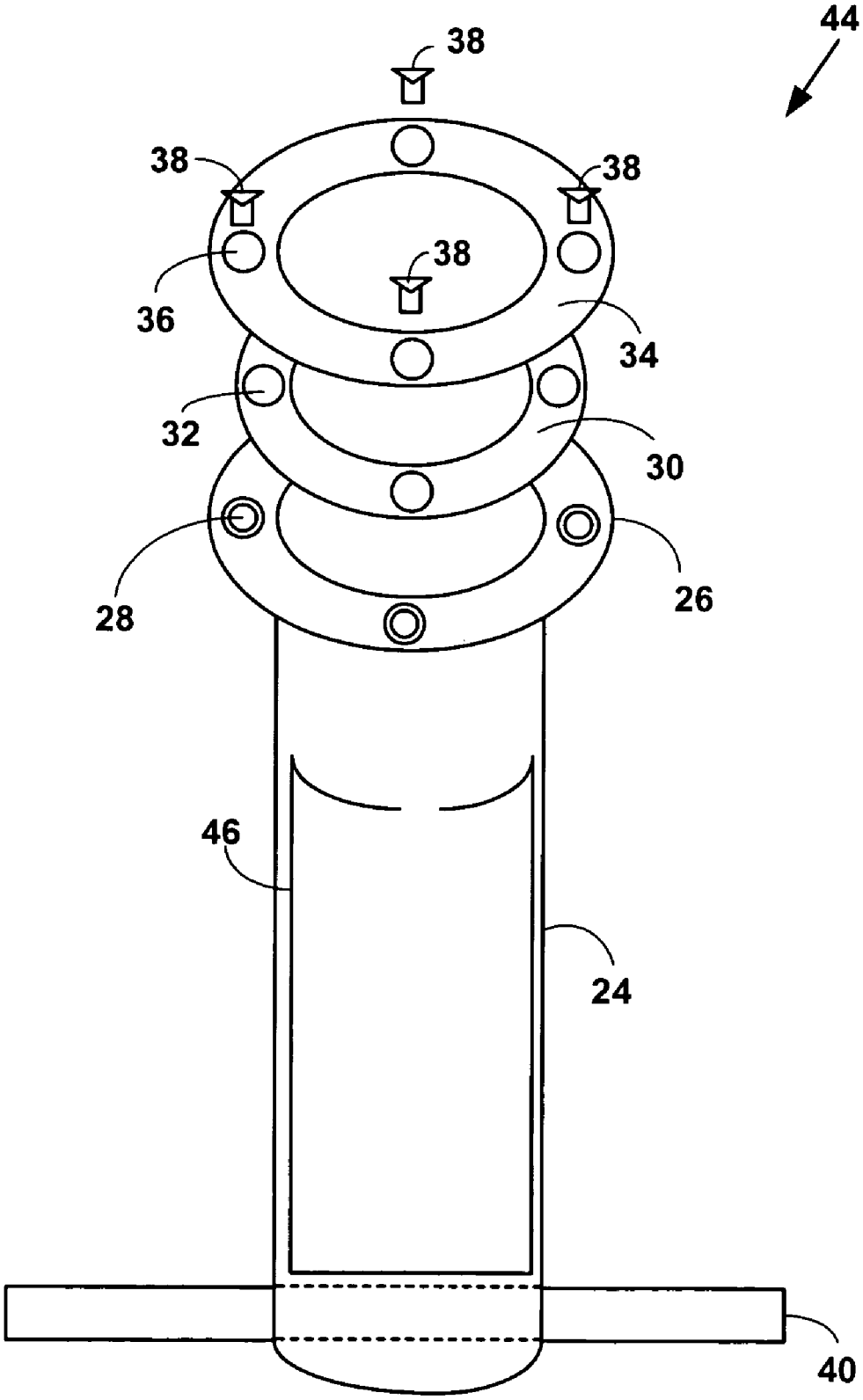
FIG. 4 is a block diagram illustrating another embodiment of the water equipment attachment apparatus.

This embodiment is illustrated in FIG. 4 in which one horizontal attachment means 40 is illustrated. In such an embodiment, the one horizontal attachment means 40 is placed at a lower or bottom end of the rigid hollow vertical tube 24. However, the present invention is not limited to this embodiment and the horizontal attachment means can be placed any where on the rigid hollow vertical tube 24.

FIG. 4 is a block diagram illustrating another embodiment 44 of the water equipment attachment apparatus 22. This embodiment includes a piece of water equipment 46 inside the rigid hollow vertical tube 24 that is directly resting on the horizontal attachment means 40. This embodiment is typically used on a bottom of a containing structure of the contained body of water 12 and is typically underwater. The horizontal attachments means 40 and the rigid hollow vertical tube 24 may be encased in concrete or other material to provide attachment and support for the piece of water equipment 46 that is included in the water attachment apparatus 22.

However, the present invention is not limited to these embodiments and the horizontal attachment means 40 can comprise other types of attachment means.

Figure 5:
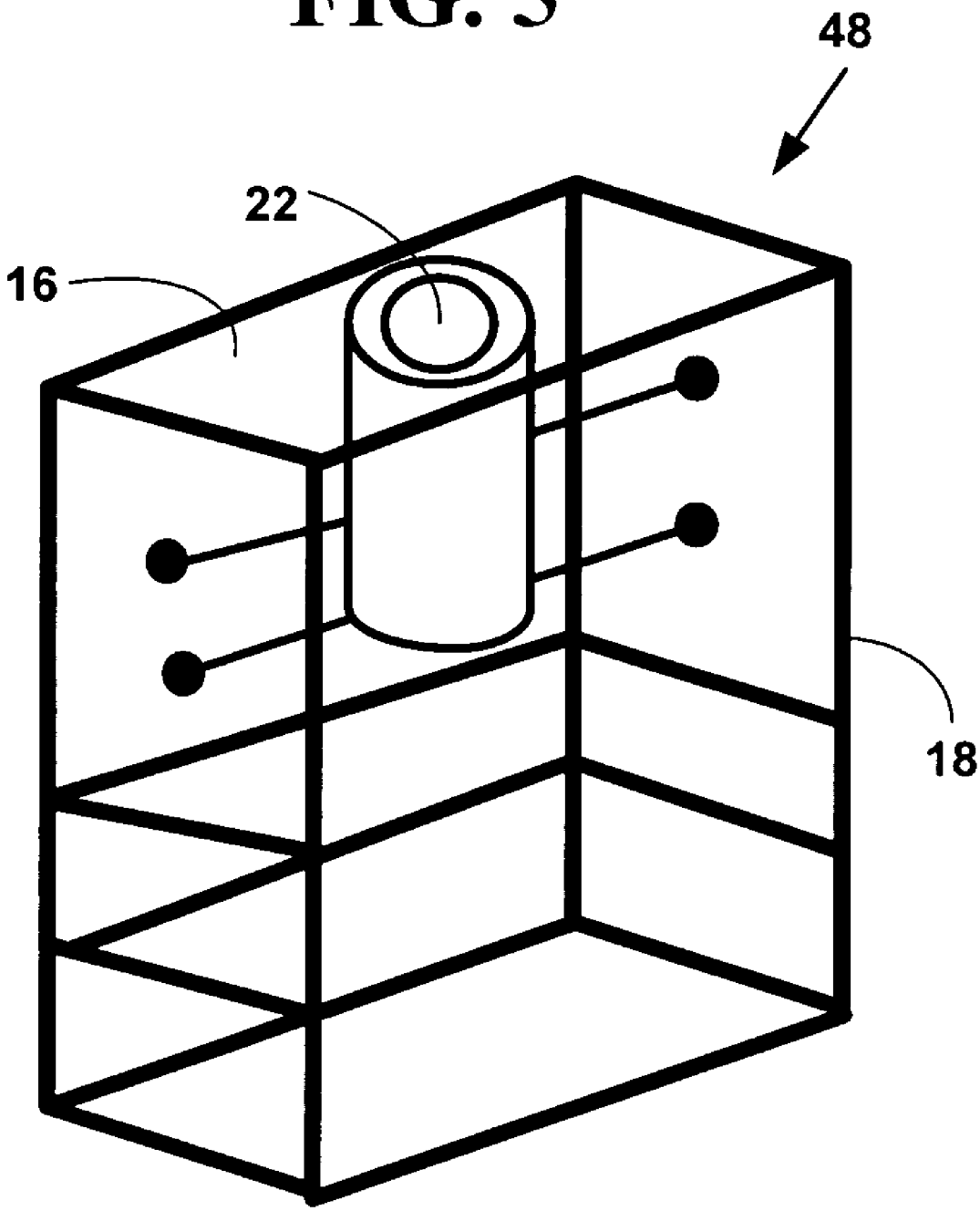
FIG. 5 is a block diagram illustrating attachment of the water attachment apparatus into one of plural attachable panels of the rigid walls.

FIG. 5 is a block diagram 48 illustrating attachment of the water attachment apparatus 22 of FIG. 3 into one of plural attachable panels 18 of the rigid walls 16. In such an embodiment, the horizontal attachment means 40 are sized to fit within the width of an attachable panel 18 and would attach through the attachable panel 18 into an adjoining attachable panel on each side. In this illustrated embodiment the water attachment apparatus 22 is illustrated as attached vertically. In another embodiment, the water attachment apparatus 22 can also be attached horizontally (e.g., into a side wall of the containing structure of the contained body of water 12, see FIG. 7).

Figure 6:
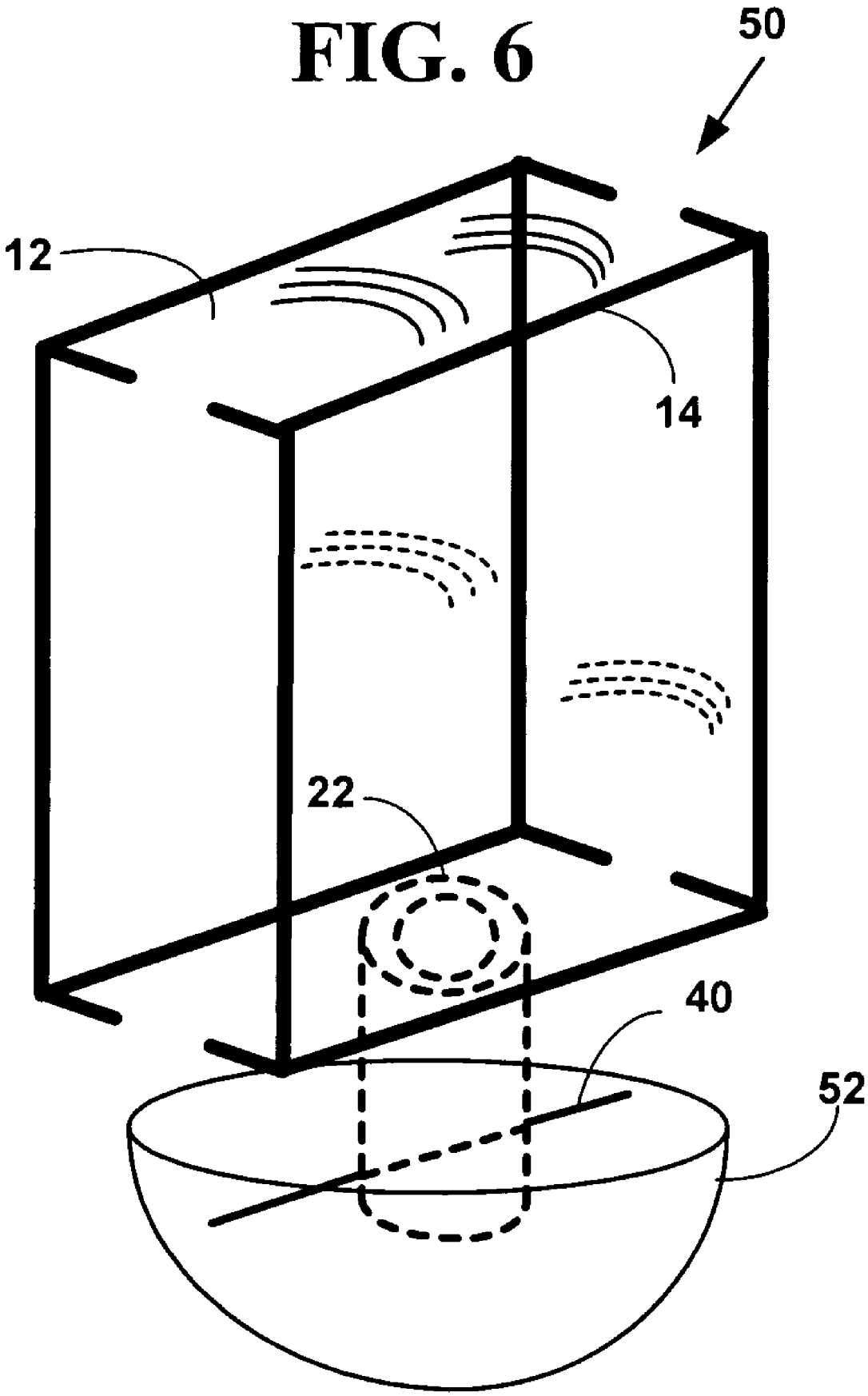
FIG. 6 is a block diagram illustrating attachment of the water attachment apparatus of FIG. 4 into a bottom of a containing structure of the contained body of water.

FIG. 6 is a block diagram 50 illustrating attachment of the water attachment apparatus 22 of FIG. 4 into a bottom of a containing structure of the contained body of water 12. This embodiment is typically under the surface of the contained water. The horizontal attachments means 40 and the rigid hollow vertical tube 24 may be encased in concrete 52 or other material to provide attachment and support for the piece of water equipment 46 that is included in the water attachment apparatus 22.

Figure 7:
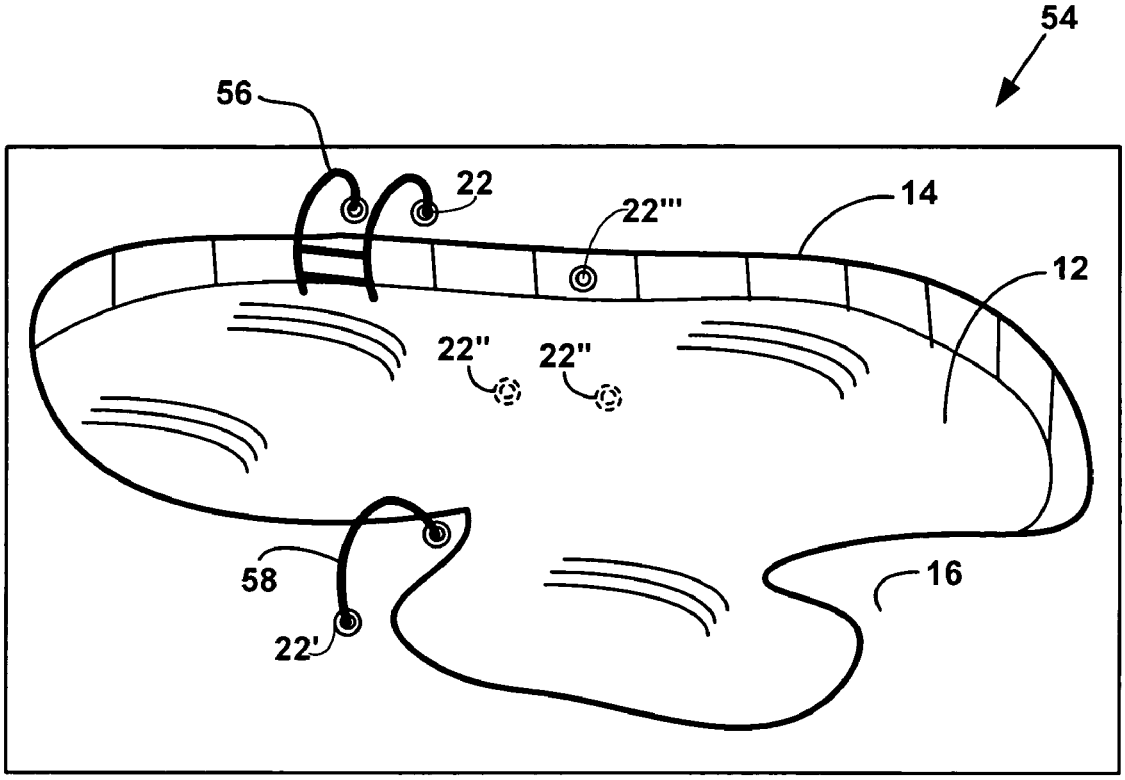
FIG. 7 is a block diagram illustrating use of the water attachment apparatus.

FIG. 7 is a block diagram 54 illustrating use of the water attachment apparatus 22. A water attachment apparatus 22 is used to attached a ladder 56 directly in a top of the thin rigid wall 16, a water attachment apparatus 22' is used to attach a handrail 58 in a top of the thin rigid wall 16, a water attachment apparatus 22" is available in a bottom of the contained body of water 12 and a water attachment apparatus 22'" is available in a sidewall of the thin rigid wall 16 of the contained body of water 12.

The water attachment equipment apparatus 22 provides a means to attach water equipment such as ladders, handrails, sports equipment, chairs and other equipment into a containing structure of a contained body of water such as swimming pool, fountain, decretive pond, etc. including a flexible material liner such as a vinyl liner. The water attachment equipment apparatus 22 can be attached to a top, side or bottom of the containing structure of contained body of water through the vinyl liner with thin support walls without leaking or structural failures.

It should be understood that the architecture, programs, processes, methods and systems described herein are not related or limited to any particular type of components or material unless indicated otherwise. Various types of general purpose or specialized components or materials may be used with or perform operations in accordance with the teachings described herein.

In view of the wide variety of embodiments to which the principles of the present invention can be applied, it should be understood that the illustrated embodiments are exemplary only, and should not be taken as limiting the scope of the present invention. For example, more or fewer elements may be used in the block diagrams.

The claims should not be read as limited to the described order or elements unless stated to that effect. In addition, use of the term "means" in any claim is intended to invoke 35 U.S.C. § 112, paragraph 6, and any claim without the word "means" is not so intended. Therefore, all embodiments that come within the scope and spirit of the following claims and equivalents thereto are claimed as the invention.

I claim:

1. A water equipment attachment apparatus, comprising in combination:

a rigid hollow vertical tube for extending below or into a selected surface of a containing structure of a contained body of water including a liner made of a flexible material, wherein the rigid hollow vertical tube includes an attachment member extending beyond a top of the rigid hollow vertical tube for engaging the selected surface of the containing structure of the contained body of water underneath the liner and wherein the attachment member includes a plurality attachment receptacles therein;

a gasket having an opening therein for engaging the attachment member of the rigid hollow vertical tube, wherein the gasket is placed over the liner to engage the attachment member of the rigid hollow vertical tube, and wherein the gasket includes a plurality of attachments openings therein;

a cap having an opening therein for engaging the gasket and for attaching to the attachment member of the rigid hollow vertical tube, wherein the cap is placed over the gasket to engage the attachment member of the rigid hollow vertical tube, thereby providing a water-tight connection and wherein the gasket includes a plurality of attachment openings therein;

a plurality of attachment means for attaching the cap and gasket to the attachment member of the rigid hollow vertical tube through the plurality of attachment openings in the cap and the gasket and into the plurality of attachment receptacles in the attachment member of the rigid hollow vertical tube;

a first horizontal attachment means extending from a first side and a second side of the rigid hollow vertical tube at a first position for attaching the rigid hollow vertical tube to the selected surface of the containing structure of the contained body of water; and a second horizontal attachment means extending from a first side and a second side of the rigid hollow vertical tube at a second position for attaching the rigid hollow vertical tube to the selected surface of the containing structure of the contained body of water.

2. The water equipment attachment apparatus of claim 1 wherein the rigid hollow vertical tube comprises metal, plastic or composite material.

3. The water equipment attachment apparatus of claim 1 wherein the gasket comprises a rubber, cork or composite material.

4. The water equipment attachment apparatus of claim 1 wherein the cap comprises a flat or a contoured cap.

5. The water equipment attachment apparatus of claim 1 wherein the plurality of attachment means includes screws, bolts, rivets or pins.

6. The water equipment attachment apparatus of claim 1 wherein the first or second horizontal attachment means include horizontal attachment means that extend through the rigid hollow vertical tube in pre-drilled holes for the attachment means.

7. The water equipment attachment apparatus of claim 1 wherein the one or more horizontal attachment means includes one or more horizontal attachment means that do not extend through the rigid hollow vertical tube.

8. The water equipment attachment apparatus of claim 1 wherein the liner is a vinyl liner.

9. The water equipment attachment apparatus of claim 1 wherein the containing structure comprises a plurality of attachable panels.

10. The water equipment attachment apparatus of claim 1 wherein the one or more horizontal attachment means are sized and dimensioned to attach to the selected surface of the containing structure of the contained body of water.

11. The water equipment attachment apparatus of claim 1 wherein the contained body of water includes a swimming pool, fountain spa, whirlpool, or decretive pond.

12. The water equipment attachment apparatus of claim 1 wherein the water equipment attachment apparatus is attached through the liner to a top wall, a side wall or a bottom of the containing structure of the contained body of water.

13. A swimming pool equipment attachment apparatus, comprising in combination:

a rigid hollow vertical tube for extending below or into a selected surface of a wall of a swimming pool including a vinyl liner, wherein the rigid hollow vertical tube includes an attachment member extending beyond a top of the rigid hollow vertical tube for engaging the selected surface of the wall of the swimming pool underneath the liner and wherein the attachment member includes a plurality attachment receptacles therein;

a gasket having an opening therein for engaging the attachment member of the rigid hollow vertical tube, wherein the gasket is placed over the liner to engage the attachment member of the rigid hollow vertical tube, and wherein the gasket includes a plurality of attachments openings therein;

a cap having an opening therein for engaging the gasket and for attaching to the attachment member of the rigid hollow vertical tube, wherein the cap is placed over the gasket to engage the attachment member of the rigid hollow vertical tube, thereby providing a water-tight connection and wherein the gasket includes a plurality of attachment openings therein;

a plurality of attachment means for attaching the cap and gasket to the attachment member of the rigid hollow vertical tube through the plurality of attachment openings in the cap and the gasket and into the plurality of attachment receptacles in the attachment member of the rigid hollow vertical tube; and one or more horizontal attachment means extending from a first side and a second side of the rigid hollow vertical tube for attaching the rigid hollow vertical tube to the selected surface of the wall of the swimming pool, wherein the one or more horizontal attachment means extend through the rigid hollow vertical tube in pre-drilled holes.

14. The swimming pool equipment attachment apparatus of claim 13 wherein the rigid hollow vertical tubes comprises metal, plastic or composite material.

15. The swimming pool equipment attachment apparatus of claim 13 wherein the gasket comprises a rubber, cork or composite material.

16. The swimming pool equipment attachment apparatus of claim 13 wherein the cap comprises a flat or a contoured cap.

17. The swimming pool equipment attachment apparatus of claim 13 wherein the plurality of attachment means includes screws, bolts, rivets or pins.

18. The water equipment attachment apparatus of claim 13 wherein the one or more horizontal attachment means include one or more horizontal attachment means that extend through the rigid hollow vertical tube in pre-drilled holes for the one or more attachment means in any position on rigid hollow vertical tube.

19. The water equipment attachment apparatus of claim 13 wherein the one or more horizontal attachment means include one or more horizontal attachment means that do not extend through the rigid hollow vertical tube.

20. The water equipment attachment apparatus of claim 13 wherein the wall comprises a plurality of attachable panels.

21. The water equipment attachment apparatus of claim 13 wherein the water equipment attachment apparatus is attached to a top wall, a side wall or a bottom of the swimming pool.

22. The water equipment attachment apparatus of claim 13 wherein the one or more horizontal attachment means are sized and dimensioned to attach to the walls or bottom of the swimming pool.

23. A swimming pool equipment attachment apparatus, comprising in combination:

a rigid hollow vertical tube for extending below or into a selected surface of a wall of a swimming pool including a vinyl liner, wherein the rigid hollow vertical tube includes an attachment member extending beyond a top of the rigid hollow vertical tube for engaging the selected surface of the wall of the swimming pool underneath the liner and wherein the attachment member includes a plurality attachment receptacles therein and wherein the wall of the swimming pool includes a plurality of attachable panels;

a gasket having an opening therein for engaging the attachment member of the rigid hollow vertical tube, wherein the gasket is placed over the liner to engage the attachment member of the rigid hollow vertical tube, and wherein the gasket includes a plurality of attachments openings therein;

a cap having an opening therein for engaging the gasket and for attaching to the attachment member of the rigid hollow vertical tube, wherein the cap is placed over the gasket to engage the attachment member of the rigid hollow vertical tube, thereby providing a water-tight connection and wherein the gasket includes a plurality of attachment openings therein;

a plurality of attachment means for attaching the cap and gasket to the attachment member of the rigid hollow vertical tube through the plurality of attachment openings in the cap and the gasket and into the plurality of attachment receptacles in the attachment member of the rigid hollow vertical tube; and one or more horizontal attachment means sized and dimensioned to attach to walls of the swimming pool, wherein the one or more horizontal attachment means are sized and dimensioned to attach to the plurality of attachable panels used for the wall of the swimming pool.

* * * * *